US010508512B2

(12) United States Patent
Jackson et al.

(10) Patent No.: US 10,508,512 B2
(45) Date of Patent: Dec. 17, 2019

(54) INSERT SAFETY VALVE SYSTEM

(71) Applicants: Todd C. Jackson, Austin, TX (US); Ewan Sinclair, Aberdeen (GB); Gergely Kecskes, Aberdeen (GB)

(72) Inventors: Todd C. Jackson, Austin, TX (US); Ewan Sinclair, Aberdeen (GB); Gergely Kecskes, Aberdeen (GB)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/718,201

(22) Filed: Sep. 28, 2017

(65) Prior Publication Data

US 2019/0093453 A1 Mar. 28, 2019

(51) Int. Cl.
*E21B 34/12* (2006.01)
*E21B 34/10* (2006.01)
*E21B 34/00* (2006.01)

(52) U.S. Cl.
CPC ..... *E21B 34/12* (2013.01); *E21B 34/106* (2013.01); *E21B 2034/007* (2013.01)

(58) Field of Classification Search
CPC ..... E21B 34/08; E21B 34/12; E21B 34/106; E21B 2034/007
See application file for complete search history.

(56) References Cited

U.S. PATENT DOCUMENTS 4,708,163 A * 11/1987 Deaton ..... E21B 34/066 137/460
5,284,205 A 2/1994 Smith
5,366,019 A * 11/1994 Brooks ..... E21B 23/006 166/387
7,967,074 B2 * 6/2011 Lake ..... E21B 34/066 166/332.1
2004/0035586 A1 2/2004 Gudmestad et al.
2008/0190623 A1 8/2008 Mailand et al.
2009/0260807 A1 * 10/2009 Abou El Azm ..... E21B 19/22 166/250.17
2011/0284233 A1 11/2011 Nu et al.
2013/0025887 A1 * 1/2013 Richard ..... E21B 33/1285 166/387
2016/0177651 A1 * 6/2016 Lyle ..... E21B 33/038 166/345

FOREIGN PATENT DOCUMENTS

WO WO2004031535 A1 4/2004

OTHER PUBLICATIONS

International Search Report and Written Opinion for International Application No. PCT/US2018/048356; International Filing Date Aug. 28, 2018; Report dated Dec. 27, 2018 (pp. 1-13).

* cited by examiner

*Primary Examiner* — David J Bagnell
*Assistant Examiner* — Yanick A Akaragwe
(74) *Attorney, Agent, or Firm* — Cantor Colburn LLP

(57) ABSTRACT

An insert safety valve system includes a valve body including a valve member. The valve body includes a central passage and a flow path arranged radially outwardly of the central passage. A release sub is coupled to the valve body. The release sub is configured and disposed to support a downhole tool. A connector member selectively couples the release sub and the valve body.

15 Claims, 4 Drawing Sheets

INSERT SAFETY VALVE SYSTEM

BACKGROUND

In the resource exploration and recovery industry, valves are commonly used to control fluid flow both into and out from a wellbore. Valves are also commonly used to prevent formation fluids from uncontrollably leaving a wellbore. Specifically, each wellbore is provided with a tubing retrievable sub-surface safety valve (TRSSSV) that prevents uncontrolled release of formation fluids. Often times, the SSSV is in the form of a flapper valve. When accessing a wellbore with conduit, the safety valve is propped open. In order for the valve to close, the conduit must first be removed.

In some cases, an insert safety valve may be carried by the conduit. The insert safety valve may be closed even when the conduit is forcing the TRSSSV open. Presently, tool insertion and/or manipulation below the insert safety valve is difficult. The insert safety valve is carried to a desired depth, set, and an operation, such as an artificial lift, is carried out. Manipulating an insert safety valve through thousands of feet of wellbore is awkward. Therefore, the art would be receptive to a system that allows a conduit to move through an insert safety valve that is arranged at an upper portion of a wellbore.

SUMMARY

In accordance with an exemplary aspect, an insert safety valve system includes a valve body including a valve member. The valve body includes a central passage and a flow path arranged radially outwardly of the central passage. A release sub is coupled to the valve body. The release sub is configured and disposed to support a downhole tool. A connector member selectively couples the release sub and the valve body.

In accordance with another exemplary aspect, a resource exploration and recovery system includes a first system, a second system including a tubing retrievable sub-surface safety valve (TRSSSV), and an insert safety valve system coupled to the TRSSSV. The insert safety valve system includes a valve body including a valve member. The valve body includes a central passage and an flow path arranged radially outwardly of the central passage. A release sub is coupled to the valve body. The release sub is configured and disposed to support a downhole tool. A connector member selectively couples the release sub and the valve body.

In accordance with yet another exemplary aspect, a method of landing an insert safety valve includes shifting an insert safety valve through a tubing retrievable sub-surface safety valve (TRSSSV) of a wellbore, resting a valve body of the insert safety valve on a landing area of the TRSSSV, connecting the valve body of the insert safety valve to the TRSSSV, lifting a conduit coupled to the insert safety valve to disconnect a release sub, and shifting the conduit in a downhole direction with the release sub.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
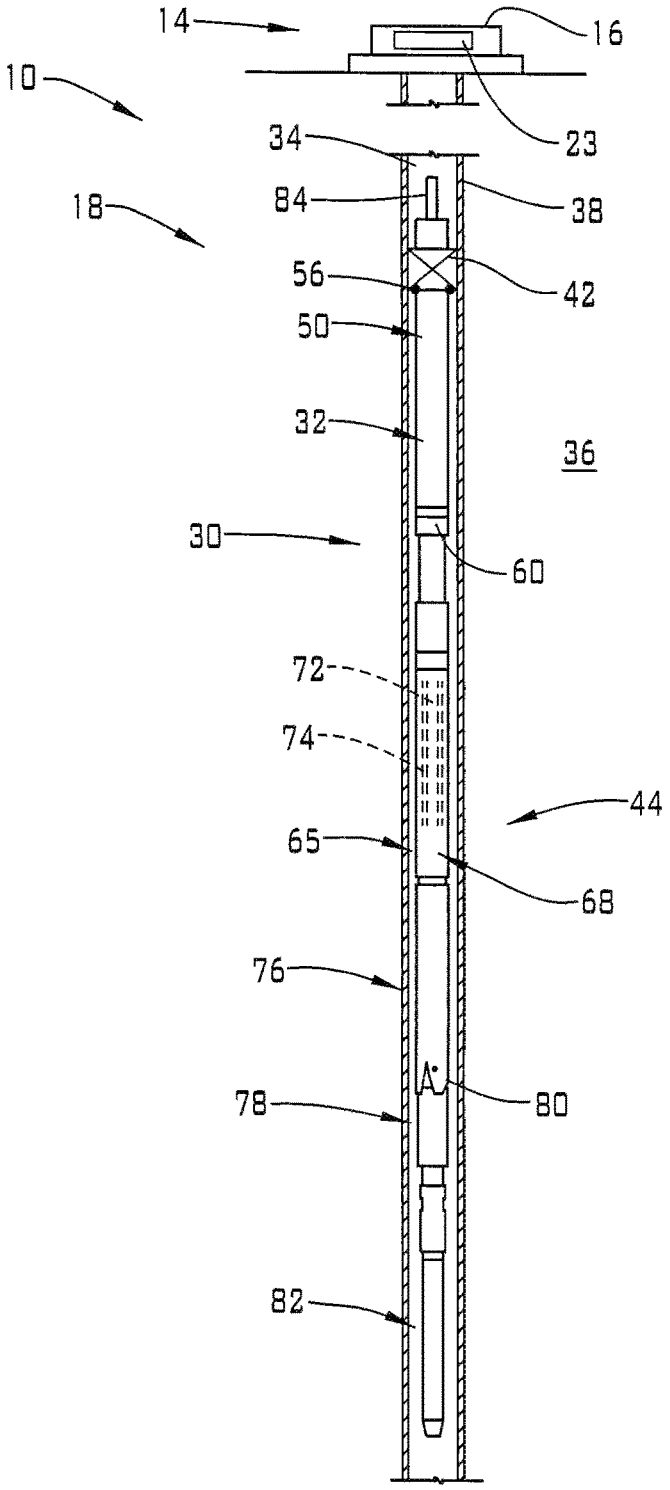
FIG. 1 depicts a resource exploration and recovery system including an insert safety valve having a release sub, in accordance with an aspect of an exemplary embodiment.
Figure 2:
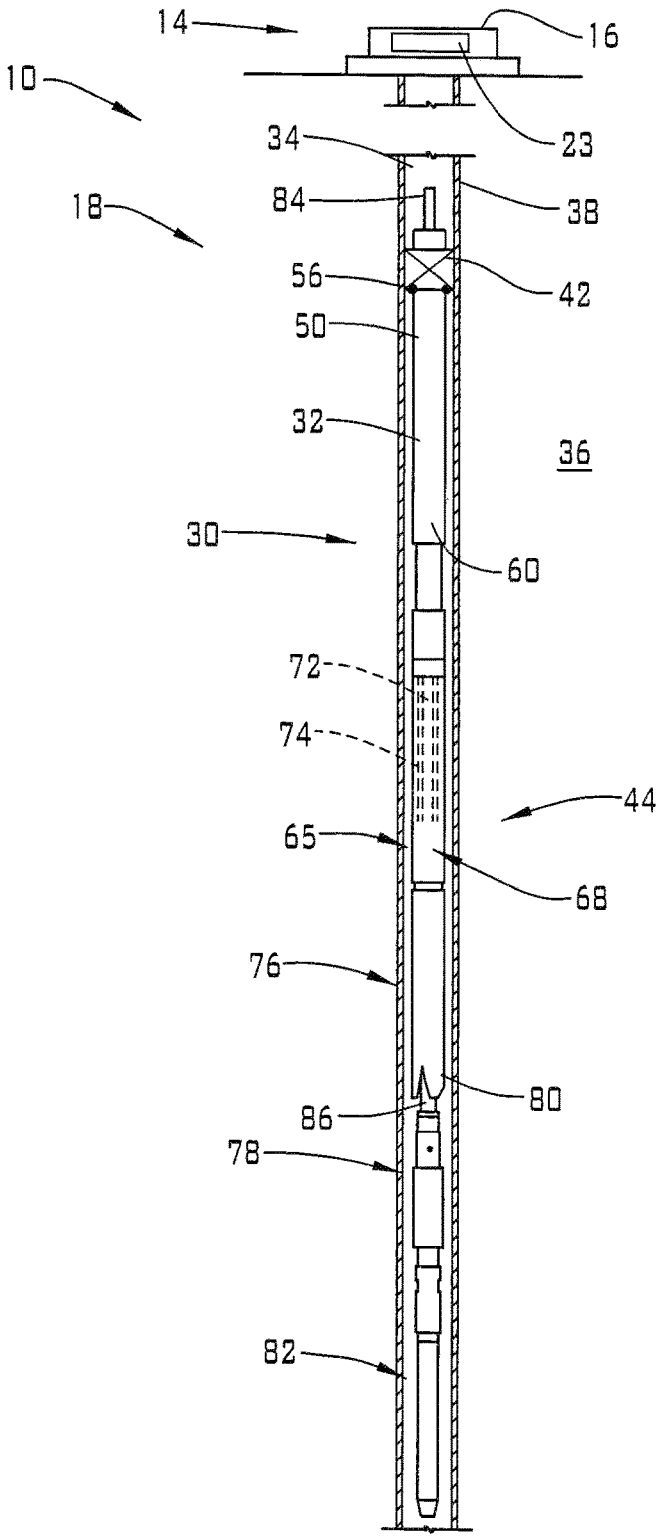
FIG. 2 depicts the insert safety valve of FIG. 1 with the release sub in a disconnected configuration.

A resource exploration and recovery system, in accordance with an exemplary embodiment, is indicated generally at 10, in FIGS. 1-2. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system. First system 14 may include a control system 23 that may provide power to, monitor, communicate with, and/or activate one or more downhole operations as will be discussed herein.

Second system 18 may include a tubular string 30 formed from a plurality of tubulars, one of which is indicated at 32 that is extended into a wellbore 34 formed in formation 36. A casing 38 may extend along wellbore 34 into formation 36. Of course, it should be understood that wellbore 34 may also be devoid of a casing. A tubing retrievable subsurface safety valve (TRSSSV) 42 is arranged at casing 38 below first system 14. TRSSSV 42 may include a valve member (not shown) that is biased towards a closed configuration. Tubular string 30 passing into wellbore 34 maintains TRSSSV 42 in an open configuration. An insert safety valve system 44 may be carried by tubular string 30. Insert safety valve system 44 may be selectively closed to prevent escape of, for example, formation fluids when TRSSSV 42 is held open.

In accordance with an aspect of an exemplary embodiment, insert safety valve system 44 includes a self-set locking sub 50 having one or more lock elements 56 that may land into and engage with a no-go zone in TRSSSV 42. Insert safety valve system 44 also includes a spacer sub 60 that straddles and isolates upper and lower portions (not separately labeled) of TRSSSV 42 and a torus valve 65.

Torus valve 65 includes a valve body 68 that has a central passage 72 and an annular flow path 74 arranged radially outwardly of central passage 72. Insert safety valve system 44 also includes a packing sub 76, a release sub 78 and a connector member 80 that selectively joins release sub 78 and packing sub 76. Release sub 78 may be operatively connected to a tool or other device 82 that may be employed downhole. The tool or other device 82 may take on a variety of forms including treatment tools, sensors, tool activators and the like.

Figure 3:
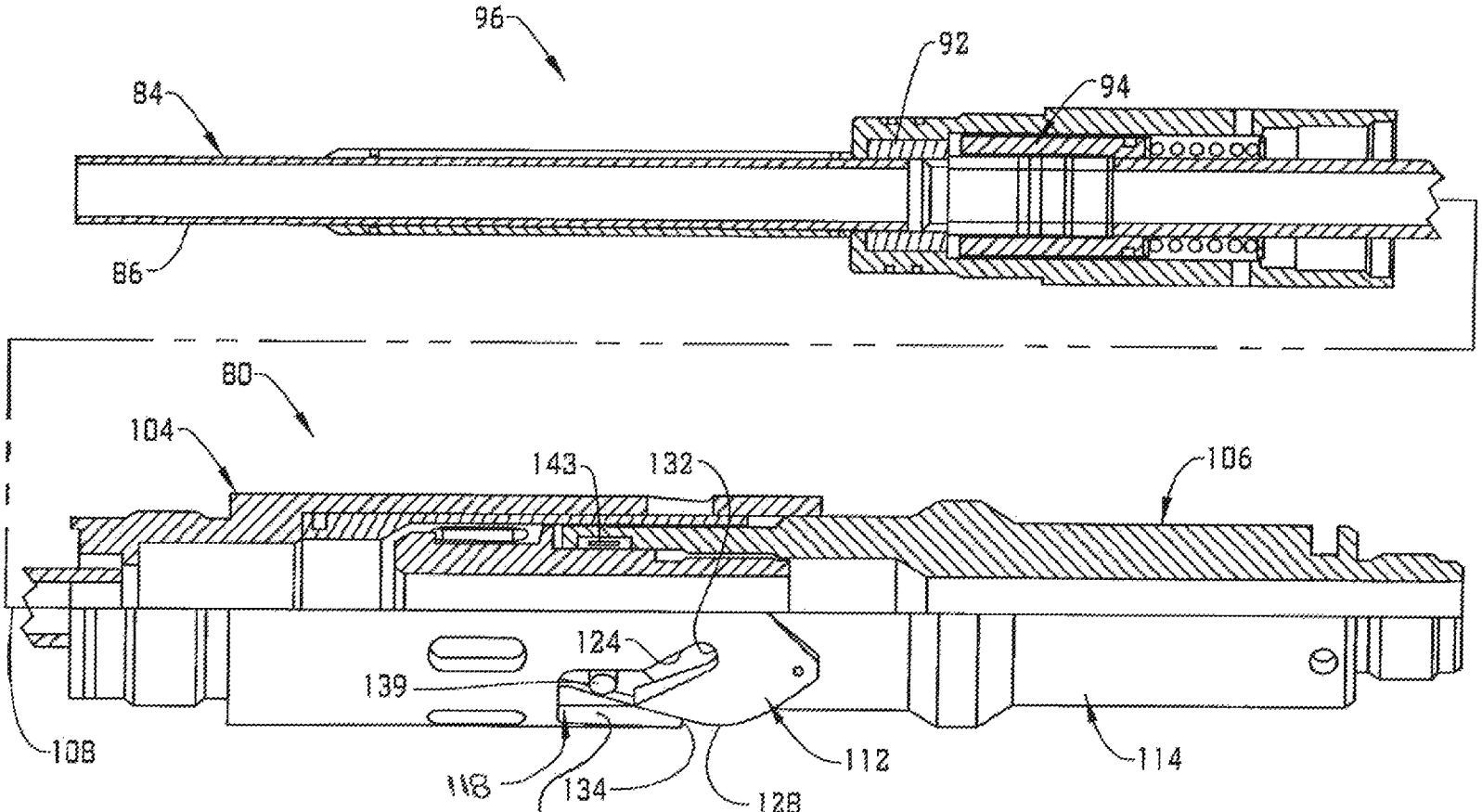
FIG. 3 depicts a packing sub and a release sub in accordance with an aspect of an exemplary embodiment.
Figure 4:
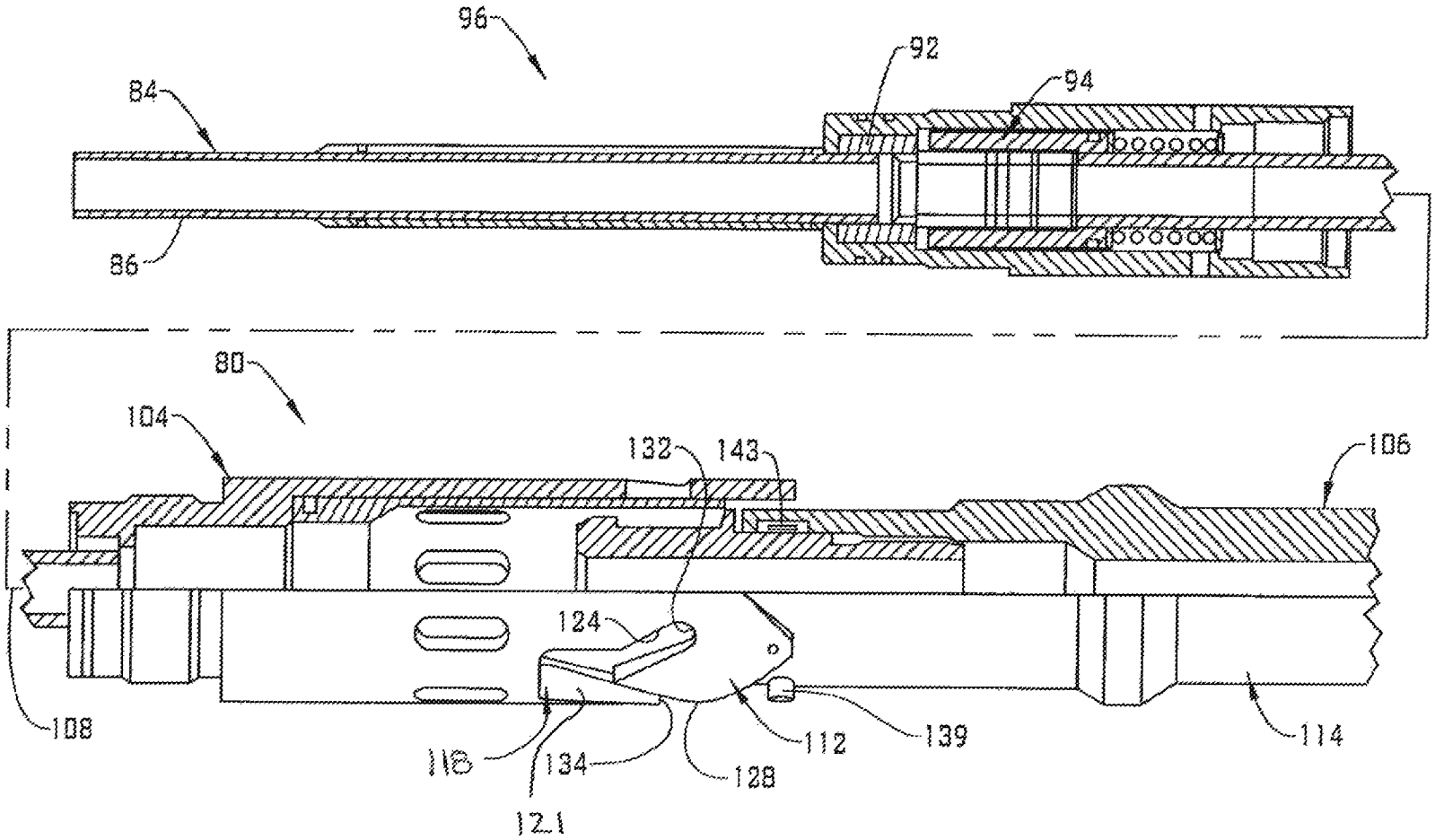
FIG. 4 depicts the release sub of FIG. 3 in a disconnected configuration, in accordance with an aspect of an exemplary embodiment.

Tool or other device 82 may be connected to a conduit 84 that may take the form of coil tubing 86. Conduit 84 may also take the form of electrical cables, communication cables, fiber optic cables or the like. Conduit 84 extends through packing sub 76 and through central passage 72 of torus valve 65 and extends to first system 14. As shown in FIGS. 3-4, packing sub 76 includes a packing element or seal 92 and an actuator 94. Activator 94 may be controlled to urge seal 92 radially inwardly to engage with conduit 84 once tool or other device 82 is at a desired location.

In further accordance with an exemplary aspect, connector member 80 includes a stationary portion 104 and a moveable portion 106 that may rotate about a longitudinal axis 108 extending through insert safety valve system 44. Stationary portion 104 includes a first connector section 112, and moveable portion 106 includes a second connector section 114. First connector section 112 includes a slot 118 having a non-linear profile.

More specifically, slot 118 includes a main section 121, a first branch section 124 and a second branch section 128. First branch section 124 extends outwardly from main section 121 at a first angle relative to longitudinal axis 108, and second branch section 128 extends outwardly from main section 121 at a second angle relative to longitudinal axis 108. First branch section 124 includes an end wall 132 and second branch section 128 includes an opening 134 exposed to main section 121. Second connector section 114 includes a pin member 138 that may transition along slot 118. Pin member 138 rests in first branch section 124 during deployment downhole. A biasing element 143 urges pin member 138 toward second branch section 128 after deployment.

In accordance with an exemplary aspect, insert safety valve system 44 is guided into wellbore 34 through TRSSSV 42. Once self-set locking sub 50 reaches a no-go point (notseparately labeled) or landing area, lock elements 56 may be deployed to secure insert safety valve system 44. Spacer sub 60 may then be activated to engage seals (not shown). Once in position, conduit 84 may be lifted causing pin member 138 to move into main section 121. Conduit 84 is then let down with biasing element 143, urging pin member 138 into second branch section 128. Pin member 138 may slide free of first connector section 112, allowing release sub 78 to move in a downhole direction to a selected depth with tool or other device 82. Once at the selected depth, packing sub 76 may be activated to force seal 92 radially inwardly onto conduit 84. With this arrangement, the exemplary embodiments enable through tubing valve installation of coiled tubing or other conduits to guide a tool or other device to a selected downhole location.

Set forth below are some embodiments of the foregoing disclosure:

Embodiment 1: An insert safety valve system comprising a valve body including a valve member, the valve body including a central passage and a flow path arranged radially outwardly of the central passage, a release sub coupled to the valve body, the release sub being configured and disposed to support a downhole tool, and a connector member selectively coupling the release sub and the valve body.

Embodiment 2: The insert safety valve system according to any prior embodiment, wherein the connector member includes a stationary portion connected to the valve body and a moveable portion connected to the release sub, the stationary portion including a first connector section and the moveable portion including a second connector section that is selectively coupled to the first connector section.

Embodiment 3: The insert safety valve system according to any prior embodiment, wherein the first connector section includes a slot having a non-linear contour.

Embodiment 4: The insert safety valve system according to any prior embodiment, wherein the slot includes a main section, a first branch section extending annularly outwardly from the main section in a first direction and a second branch section extending annularly outwardly from the main section in a second direction.

Embodiment 5: The insert safety valve system according to any prior embodiment, wherein the first branch section includes an end wall and the second branch section includes an opening that extends through an axial end of the stationary portion.

Embodiment 6: The insert safety valve system according to any prior embodiment, wherein the connector member includes a longitudinal axis extending from the valve body through the connector member, the first branch section extending at a first angle relative to the longitudinal axis and the second branch section extending at a second angle relative to the longitudinal axis.

Embodiment 7: The insert safety valve system according to any prior embodiment, wherein the moveable portion includes a pin member extending into the slot.

Embodiment 8:The insert safety valve system according to any prior embodiment, further comprising: a biasing element applying a rotational force to the moveable portion, biasing the pin member towards the second branch section.

Embodiment 9: The insert safety valve system according to any prior embodiment, further comprising: a packing sub arranged between the valve member and the release sub, the packing sub including a selectively radially inwardly expandable packing element.

Embodiment 10: A resource exploration and recovery system comprising a first system, a second system including a tubing retrievable sub-surface safety valve (TRSSSV), and an insert safety valve system coupled to the TRSSSV, the insert safety valve system comprising a valve body including a valve member, the valve body including a central passage and an flow path arranged radially outwardly of the central passage, a release sub coupled to the valve body, the release sub being configured and disposed to support a downhole tool, and a connector member selectively coupling the release sub and the valve body.

Embodiment 11: The insert safety valve system according to any prior embodiment, wherein the connector member includes a stationary portion connected to the valve body and a moveable portion connected to the release sub, the stationary portion including a first connector section and the moveable portion including a second connector section that is selectively coupled to the first connector section.

Embodiment 12: The resource exploration and recovery system according to any prior embodiment, further comprising a slot having a non-linear profile, the slot including a main section, a first branch section extending annularly outwardly from the main section in a first direction and a second branch section extending annularly outwardly from the main section in a second direction.

Embodiment 13: The resource exploration and recovery system according to any prior embodiment, wherein the first branch section includes an end wall and the second branch section includes an opening that extends through an axial end of the stationary portion.

Embodiment 14: The resource exploration and recovery system according to any prior embodiment, wherein the moveable portion includes a pin member extending into the slot.

Embodiment 15: The resource exploration and recovery system according to any prior embodiment, further comprising a biasing element applying a rotational force to the moveable portion biasing the pin member towards the second branch section.

Embodiment 16: The resource exploration and recovery system according to any prior embodiment, further comprising a packing sub arranged between the valve member and the release sub, the packing sub including a selectively radially inwardly expandable packing element.

Embodiment 17: A method of landing an insert safety valve comprising shifting an insert safety valve through a tubing retrievable sub-surface safety valve (TRSSSV) of a wellbore, resting a valve body of the insert safety valve on a landing area of the TRSSSV, connecting the valve body of the insert safety valve to the TRSSSV, lifting a conduit coupled to the insert safety valve to disconnect a release sub, and shifting the conduit in a downhole direction with the release sub.

Embodiment 18: The method of any prior embodiment, wherein lifting the conduit includes biasing a pin member into a branch section of a slot having an opening.

Embodiment 19: The method of any prior embodiment, wherein shifting the conduit includes passing the conduit through a packing sub connected with the TRSSSV.

Embodiment 20: The method of any prior embodiment, further comprising: radially inwardly expanding a packing element of the packing sub to seal against the conduit.

The use of the terms "a" and "an" and "the" and similar references in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An insert safety valve system comprising:

a valve body including a valve member, the valve body including a central passage and a flow path arranged radially outwardly of the central passage;

a release sub coupled to the valve body, the release sub being configured and disposed to support a downhole tool; and a connector member selectively coupling the release sub and the valve body, the connector member including a stationary portion connected to the valve body and a moveable portion connected to the release sub, the stationary portion including a first connector section including a slot having a non-linear contour and the moveable portion including a second connector section that is selectively coupled to the first connector section.

2. The insert safety valve system according to claim 1, wherein the slot includes a main section, a first branch section extending annularly outwardly from the main section in a first direction and a second branch section extending annularly outwardly from the main section in a second direction.

3. The insert safety valve system according to claim 2, wherein the first branch section includes an end wall and the second branch section includes an opening that extends through an axial end of the stationary portion.

4. The insert safety valve system according to claim 2, wherein the connector member includes a longitudinal axis extending from the valve body through the connector member, the first branch section extending at a first angle relative to the longitudinal axis and the second branch section extending at a second angle relative to the longitudinal axis.

5. The insert safety valve system according to claim 2, wherein the moveable portion includes a pin member extending into the slot.

6. The insert safety valve system according to claim 5, further comprising: a biasing element applying a rotational force to the moveable portion, biasing the pin member towards the second branch section.

7. The insert safety valve system according to claim 1, further comprising: a packing sub arranged between the valve member and the release sub, the packing sub including a selectively radially inwardly expandable packing element.

8. A resource exploration and recovery system comprising:

a first system;

a second system including a tubing retrievable sub-surface safety valve (TRSSSV); and an insert safety valve system coupled to the TRSSSV, the insert safety valve system comprising:

a valve body including a valve member, the valve body including a central passage and an flow path arranged radially outwardly of the central passage;

a release sub coupled to the valve body, the release sub being configured and disposed to support a downhole tool; and a connector member selectively coupling the release sub and the valve body, the connector member including a stationary portion connected to the valve body and a moveable portion connected to the release sub, the stationary portion including a first connector section including a slot having a non-linear contour and the moveable portion including a second connector section that is selectively coupled to the first connector section.

9. The resource exploration and recovery system according to claim 8, wherein the slot includes a main section, a first branch section, and a second branch section, the first branch section including an end wall and the second branch section including an opening that extends through an axial end of the stationary portion.

10. The resource exploration and recovery system according to claim 9, wherein the moveable portion includes a pin member extending into the slot.

11. The resource exploration and recovery system according to claim 10, further comprising: a biasing element applying a rotational force to the moveable portion biasing the pin member towards the second branch section.

12. The resource exploration and recovery system according to claim 8, further comprising: a packing sub arranged between the valve member and the release sub, the packing sub including a selectively radially inwardly expandable packing element.

13. A method of landing an insert safety valve comprising:

shifting an insert safety valve through a tubing retrievable sub-surface safety valve (TRSSSV) of a wellbore;

resting a valve body of the insert safety valve on a landing area of the TRSSSV;

connecting the valve body of the insert safety valve to the TRSSSV;

lifting a conduit coupled to the insert safety valve to disconnect a release sub by biasing a pin member into a branch section od a slot in a connector section, the slot including a non-linear profile, the branch section having an opening: and shifting the conduit in a downhole direction with the release sub.

14. The method of claim 13, wherein shifting the conduit includes passing the conduit through a packing sub connected with the TRSSSV.

15. The method of claim 14, further comprising: radially inwardly expanding a packing element of the packing sub to seal against the conduit.

* * * * *